US005924352A

United States Patent [19]

Lothe

[11] Patent Number: 5,924,352

[45] Date of Patent: Jul. 20, 1999

[54] ADJUSTABLE SLICER GUIDE

[75] Inventor: Arlan D. Lothe, Sun Prairie, Wis.

[73] Assignee: Shamrock Sales, Hutchinson, Minn.

[21] Appl. No.: 08/747,559

[22] Filed: Nov. 12, 1996

[51] Int. Cl.[6] ..... B26D 7/01

[52] U.S. Cl. ..... 83/761; 83/781; 83/932; 220/528; 269/309

[58] Field of Search ..... 83/467.1, 468.7, 83/761, 762, 781, 813, 870, 932; 269/277, 279, 309; 206/562; 220/528; D7/672, 673

[56] References Cited

U.S. PATENT DOCUMENTS

| | | | |
|---|---|---|---|
| 2,816,588 | 12/1957 | Miron | 83/761 |
| 5,577,430 | 11/1996 | Gunderson et al. | 83/870 |
| 5,626,067 | 5/1997 | Lothe | 83/761 |
| 5,664,474 | 9/1997 | Punt | 83/781 X |
| 5,832,804 | 11/1998 | Dudley et al. | 83/762 X |

*Primary Examiner*—Clark F. Dexter

*Attorney, Agent, or Firm*—Westman, Champlin & Kelly, P.A.

[57] ABSTRACT

A product slicer guide suitable for use with a food item, or the like, is disclosed. The slicer guide includes a base and a cutting board adapted to fit within the base in the plurality of selectable positions. The base includes a generally upstanding guidewall having a cutting guide surface at one end. The plurality of shim sets each having a unique height, wherein each shim set includes a plurality of shims having generally equal height, are positioned proximate the guidewall on the base. The cutting board includes a cutting surface and an underside surface generally opposite the cutting surface. The underside surface includes a plurality of primary pads having a generally equal height. For each of the selectable positions, at least some of the primary pads mate with one of the shim sets to provide a selected spacing between the guide surface and the cutting surface.

1 Claim, 13 Drawing Sheets

ADJUSTABLE SLICER GUIDE

BACKGROUND OF THE INVENTION

This invention relates to a device for controlling the slicing of products such as food. More particularly, the present invention relates to a slicer guide that can be adjusted for obtaining different width slices of the products.

The hand slicing of food items is often a time consuming and frustrating process. Slices of uniform thickness are difficult to obtain when cut by hand. It is even more difficult to obtain uniform slices if the item to be sliced is a relatively delicate product such as bread or a tomato. Hand slicing of such items often leads to damage to the shape or appearance of the products.

When preparing food, oftentimes it is desirable to have several slices of uniform thickness. Also, a food preparer may wish to prepare several items of food in which generally straight slices of different thickness are desired. The slicer guides available for this task often contain grooves which can trap food and make clean up a hassle, or the slicer guide is cumbersome and difficult to operate. Thus, there is a need for a relatively simple device which allows the food preparer to obtain a number of predetermined uniform-thickness slices wherein the device can be adjusted to the proper size quickly and can be relatively easy to maintain.

SUMMARY OF THE INVENTION

The present invention is directed to a product slicer guide suitable for use with a food item, or the like. The slicer guide includes a base and a cutting board adapted to fit within the base in a plurality of selectable positions. The base includes a generally upstanding guidewall having a cutting guide surface at one end. The plurality of shim sets each having a unique height, wherein each shim set includes a plurality of shims having generally equal height, are positioned proximate the guidewall on the base. The cutting board includes a cutting surface and an underside surface generally opposite the cutting surface. The underside surface includes a plurality of primary pads having a generally equal height. For each of the selectable positions, at least some of the primary pads mate with one of the shim sets to provide a selected spacing between the guide surface and the cutting surface.

DETAILED DESCRIPTION OF THE PREFERRED EMBODIMENTS

Figure 1:
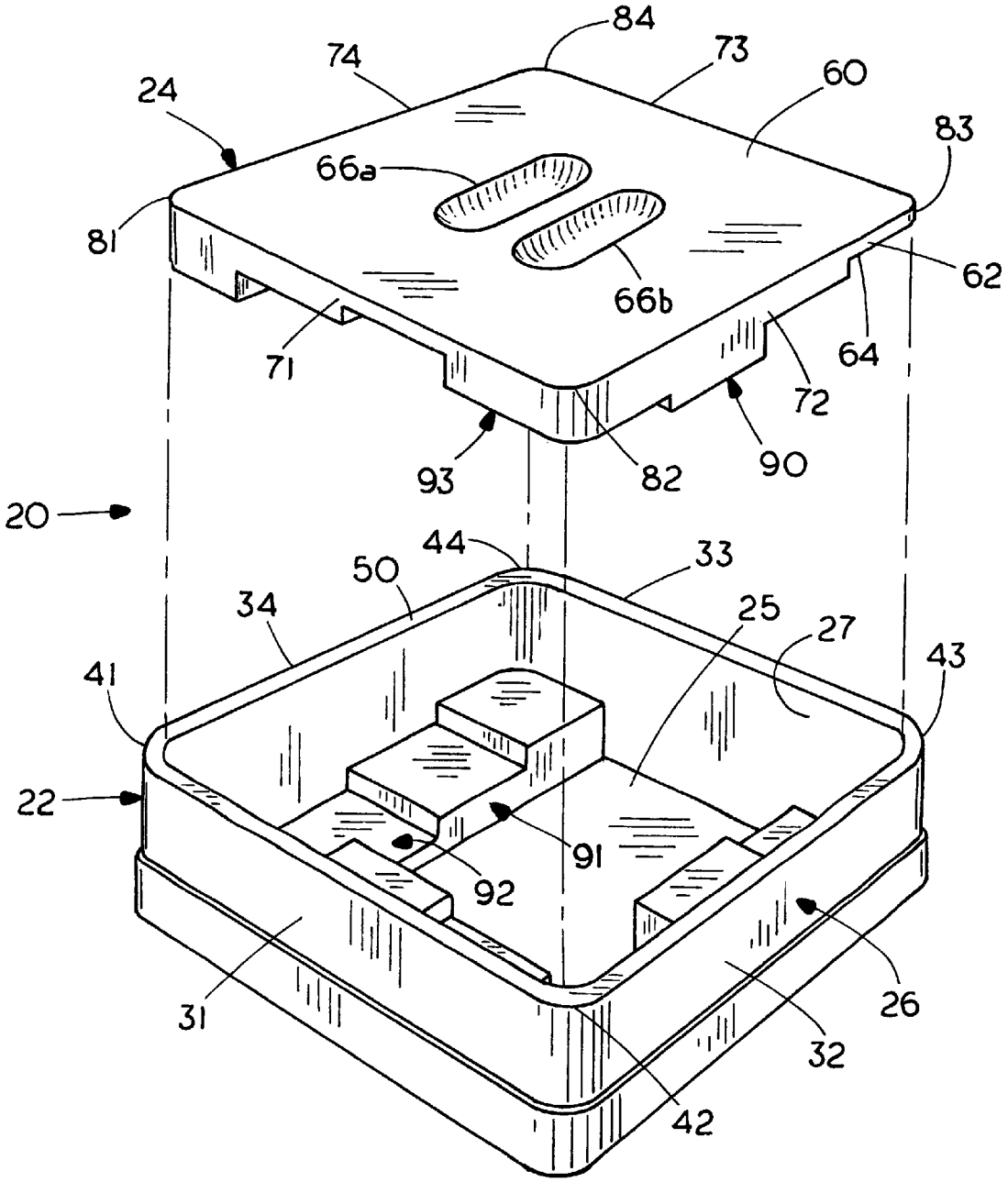
FIG. 1 shows a perspective view of a slicer guide having a base and cutting board, the slicer guide embodying features of the present invention.

FIG. 1 shows a perspective view of a slicer guide indicated generally at 20, comprising a base 22 and a cutting board 24. Preferably, the base 22 and the cutting board 24 are formed from acrylonitrile-butadiene-styrene (ABS) in a known manner, but may be fabricated from any suitable material. The base 22 includes a generally planar baseplate 25 that includes a plurality of non-skid rubber feet (not shown) affixed to the underside of the preferred embodiment. The base 22 includes a guidewall 26 around the perimeter of the baseplate 25 wherein the guidewall inner surface 27 is generally perpendicular to the baseplate 25. The guidewall 26 is formed into four sides of generally equal height, i.e., first base side 31, second base side 32, third base side 33, and fourth base side 34, arranged with respect to each other as shown. Sides 34 and 31 come together to form a first base corner 41. Likewise, second, third and fourth base corners 42, 43 and 44, respectively, are arranged as shown. The guidewall 26 forms a generally planar guide surface 50 which is generally parallel to the plane of the baseplate 25.

The cutting board 24 is adapted to fit within the guidewalls 26 and includes a generally planar cutting surface 60, edge 62, and underside surface 64. The cutting surface 60 includes recesses 66*a*, 66*b* formed therein and suitable for grasping the cutting board 24 for insertion into or removal from the base 22. The cutting board 24 includes a first cutting side 71, second cutting side 72, third cutting side 73 and fourth cutting side 74, arranged as shown. Similarly, the cutting board 24 includes a first cutting corner 81, second cutting corner 82, third cutting corner 83 and fourth cutting corner 84 arranged as shown.

The cutting board includes a plurality of pads, indicated generally at 90, affixed to the underside surface 64 at the edge 62. The base 22 includes a plurality of shims, indicated generally at 91, and affixed to the baseplate 25 and along the guidewall inner surface 27. The pads 90 are suitable for mating with the shims 91. The pads 90 and shims 91 include faces, indicated generally at 92 and 93 respectively, which are generally parallel to the plane of the cutting surface 60 and baseplate 25, respectively. The pads 90 and shims 91 are arranged in a predetermined manner to allow the user to select the spacing between the cutting surface 60 and the guide surface 50, as described in detail below.

Figure 2:
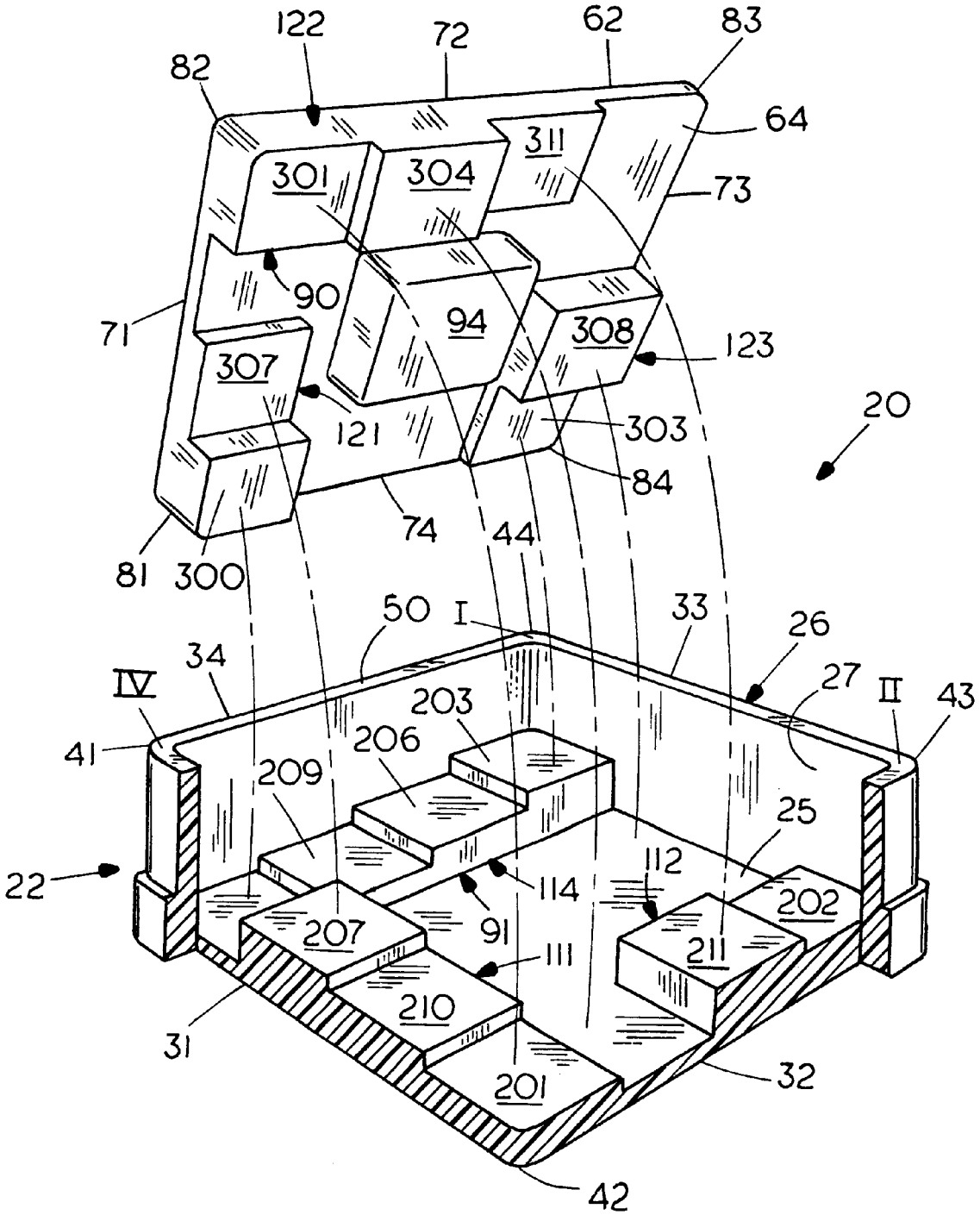
FIG. 2 shows another perspective view of the slicer guide of FIG. 1 with portions cut away, and indicating a first configuration.

FIG. 2 shows the slicer guide 20 of FIG. 1 wherein the guidewall 26 at the first base side 31 and second base side 32 is cut away to show the arrangement of the shims 91, and the cutting board underside 64 is shown to illustrate the arrangement of the pads 90. A block 94 is also affixed to the underside 64. Recesses 66*a* and 66*b* (shown in FIG. 1) are formed in the block 94. Preferably, the shims 91 are arranged as a plurality of steps along the guidewall inner surface 27. Specifically, the first shim steps 111 are arranged along the first base side 31; the second shim steps 112 are arranged along the second base side 32; and the fourth shim steps 114 are arranged along the fourth base side 34. Likewise, the pads 90 are arranged as a plurality of steps along the edge 62. The first pad steps 121 are arranged along the first cutting side 71, the second pad steps 122 are arranged along the second cutting side 72, and the third pad steps 123 are arranged along the third cutting side 73. Note, in the preferred embodiment, there are no shims 91 along the third base side 33, and no pads 90 along the fourth cutting side 74.

The individual pads 90 and shims 91 are arranged in the following manner, wherein the detail regarding the specific numbering is described below with reference to FIGS. 5–8. As shown in FIG. 2, seventh shim 207, tenth shim 210, and first shim 201 make up the first steps 111. Eleventh shim 211, and second shim 202, make up the second shim steps 112. Third, sixth and ninth shims 203, 206, and 209, respectively, make up the fourth shim steps as shown. Pads zero 300 and seven 307 make up the first pad steps 121. Pad one 301, pad four 304, and pad eleven 311 make up the second pad steps 122 as shown. Pad three 303 and pad eight 308 make up the third pad steps 123 as shown. In the preferred embodiment, first shims 201 and ninth shim 209 have generally the same predetermined height as measured along the inner guidewall surface 27 from the baseplate 25. Second, sixth and tenth shims, 202, 206, 210, respectively, have generally the same predetermined height, and are slightly taller than the first and ninth shims 201 and 209. The third, seventh and eleventh shims 203, 207, 211, respectively, have generally the same predetermined height, and are the tallest shims 91. Pads of generally equally height are considered to make-up a shim set. In the preferred embodiment, there are three shim sets.

In the preferred embodiment, pads zero, four and eight, 300, 304, 308, are the primary pads and have the greatest height as measured from the underside surface 64. The primary pads 300, 304, 308 have generally equal height. Pad one 301 is an intermediate pad and has the next greatest height. Pads three, seven and eleven 303, 307, 311, respectively, are minor pads and have the smallest height. The minor pads 303, 307 and 311 have generally equal height, also. Pads of generally equal height are considered to make-up a pad set.

Figure 3:
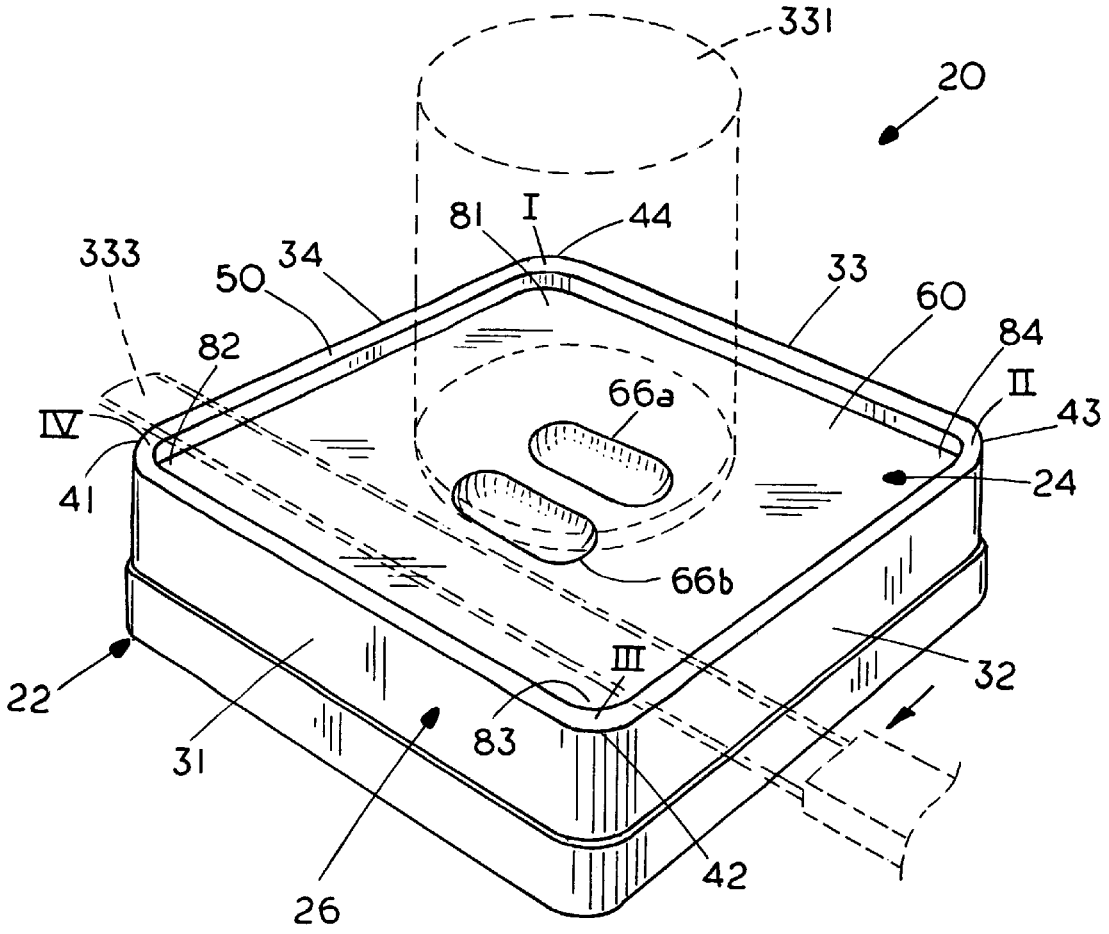
FIG. 3 shows a perspective view of the slicer guide of FIG. 1 showing its suggested use.

FIG. 3 shows the slicer guide 20 in operation. The cutting board 24 is placed within the base 22. In the arrangement shown, first base corner 41 is proximate second cutting corner 82. The shims 91 support the pads 90 and the cutting surface 60 is spaced-apart from the cutting guide surface 50. A food item 331, or the like, such as a loaf of bread, is abutted against the cutting surface 60 and within the guidewall 26. A knife-blade 333 is laid flat against the guide surface 50 and is used to cut through the food item 331 by sliding the blade 333 along the cutting guide surface 50. The result is a slice of the food item 331 with a known thickness and a straight cut. The thickness of the slice of the food item 331 is determined by the distance between the cutting guide surface 50 and the cutting surface 60 as measured generally perpendicular to the cutting surface, i.e., along the guidewall inner surface 27. The food item 331 can be repeatedly cut so as to produce several slices having the same known thickness.

Figure 4A:
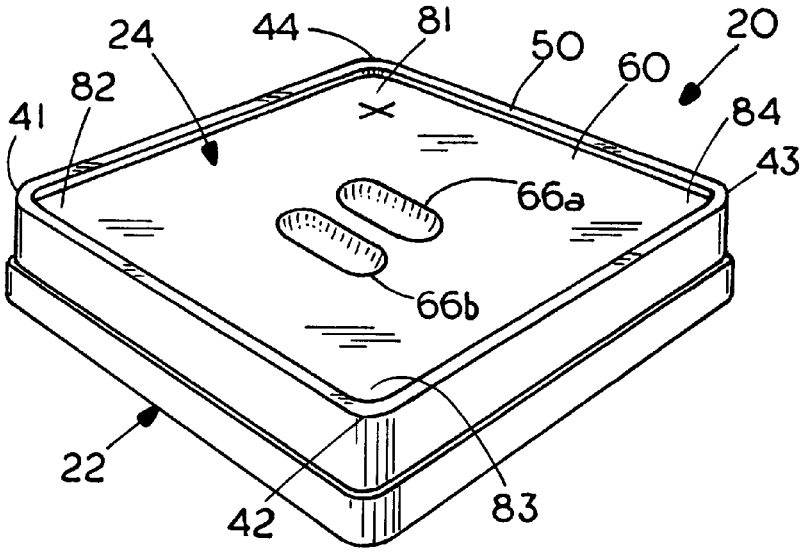
FIGS. 4A–4D show perspective views of the slicer guide of FIG. 1 and its four suggested configurations of the cutting board with respect to the base.
Figure 4B:
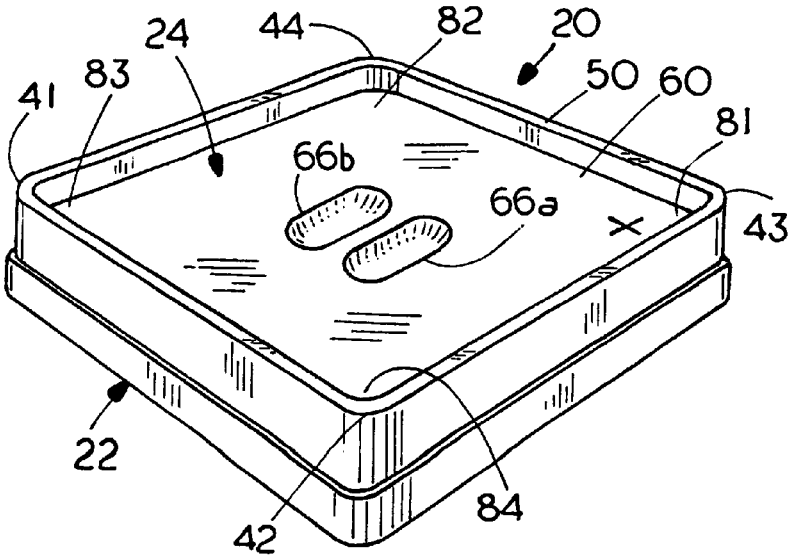
Figure 4C:
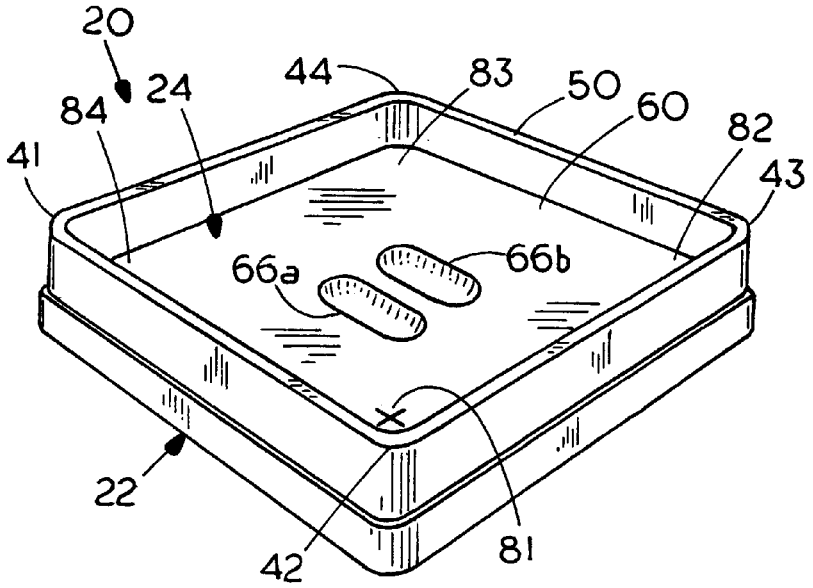
Figure 4D:
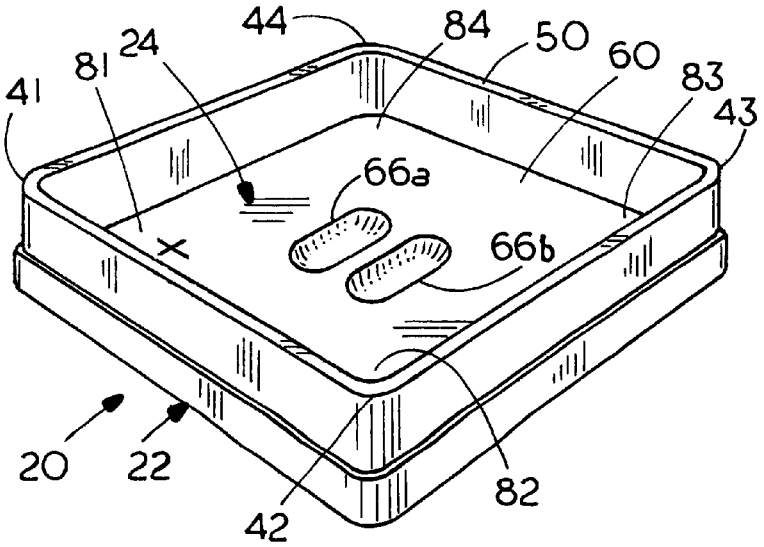

FIGS. 4A–4D show that by repositioning the cutting board 24 with respect to the base 22, the distance between the cutting guide surface 50 and the cutting surface 60 can be adjusted. With the particular arrangement of the pads 90 and shims 91 as set forth above, positioning the cutting board 24 with respect to the base 22 such that the second cutting corner 82 is proximate the first base corner 41 as shown in FIGS. 3 and 4A, provides for a relatively small spacing, i.e., short distance, between cutting guide surface 50 and cutting surface 60. When the cutting board 24 is removed and repositioned with respect to the base 22 such that the third cutting corner 83 is proximate the first base corner 41, as shown in FIG. 4B, a relatively larger spacing between cutting guide surface 50 and cutting surface 60 is provided than that shown in FIG. 4A. When the cutting board 24 is removed and rotated such that the fourth cutting corner 84 is proximate the first base corner 41, as shown in FIG. 4C, a relatively larger spacing between cutting guide surface 50 and cutting surface 60 is provided than that shown in FIG. 4B. When the cutting board 24 is removed and repositioned such that the first cutting corner 81 is proximate the first base corner 41, as shown in FIG. 4D (and as suggested by the relative positions shown in FIGS. 1 and 2), a large spacing between cutting guide surface 50 and cutting surface 60 is provided.

The user can select any one of the four spacings between the cutting guide surface 50 and cutting surface 60 shown in FIGS. 4A–4D, which are predetermined based on such factors as the height of the guidewall 26, the thickness of the cutting board 24, the height of the shims 91, and the height of the primary pads 300, 304, and 308. The particular arrangement of pads 90 and shims 91 provides for the ability to adjust the height and is described in detail below.

Figure 5:
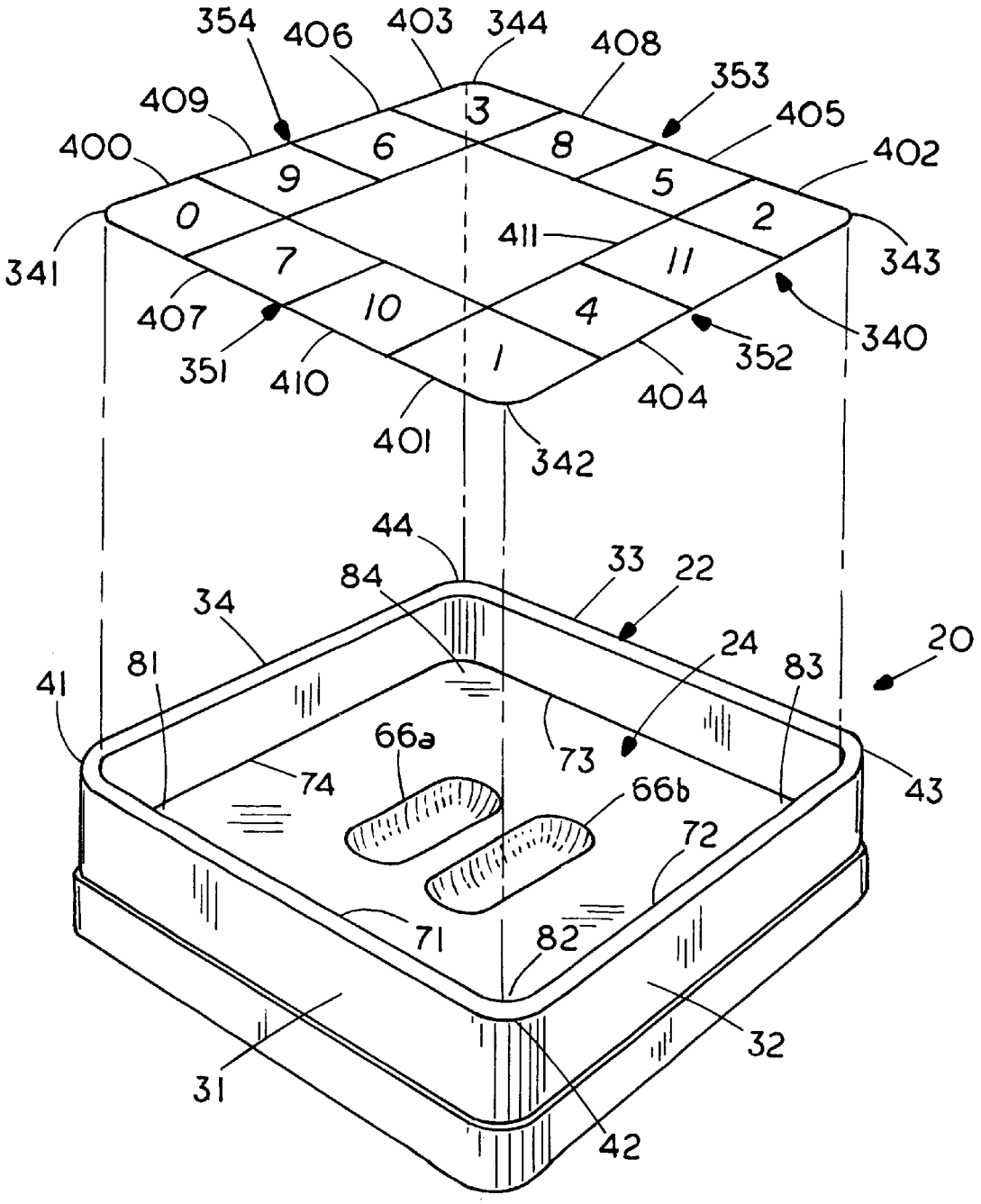
FIG. 5 shows a perspective view of the slicer guide of FIG. 1 having a template superimposed thereon.

The description of the positioning and height of the shims 90 and pads 91 can be facilitated with reference to an imaginary template 340 that is superimposed on the slicer guide 20 as shown in FIG. 5. The cutting board 24 is inserted within the base 22 as previously suggested in FIG. 1 and shown in FIG. 4D. Accordingly, base and cutting corners 41 and 81, 42 and 82, 43 and 83, and 44 and 84, respectively, are proximate each other. In this configuration, first template corner 341 corresponds with base and cutting corners 41 and 81, second template corner 342 corresponds with base and cutting corners 42 and 82, third template 343 corner corresponds with base and cutting corners 43 and 83, and fourth template corner 344 corresponds with base and cutting corners 44 and 84. Also, the template has first, second, third, and fourth sides 351, 352, 353, 354, respectively, as shown. In this configuration, the first template side 351 corresponds with the first base side 31 and the first cutting side 71, and the second template side 352 corresponds with a second base side 32 and second cutting side 72.

For purposes of illustration, each side of the template includes four positions (in general the number of positions per side is equal to the number of sides), with the corner positions common to two sides. Thus, the template includes twelve positions. In general, the number of positions is equal to the number of sides squared minus the number of sides. Specifically, starting from corner 341 and moving toward corner 342, side 351 includes side one/position one 400, side one/position two 407, side one/position three 410, and side one/position four 401. Now continuing toward corner 343, side 352 also includes side two/position two 404, side two/position three 411, and side two/position four 402. Now continuing toward corner 344, side 353 also includes side three/position two 405, side three/position three 408 and side three/position four 403. Finally, side four 354 includes side four/position two 406 and side four/position three 409. Those skilled in the art can recognize a pattern of identifying the template positions. These positions are assigned a template number from 0 to 11 and are numbered as shown.

Figure 6A:
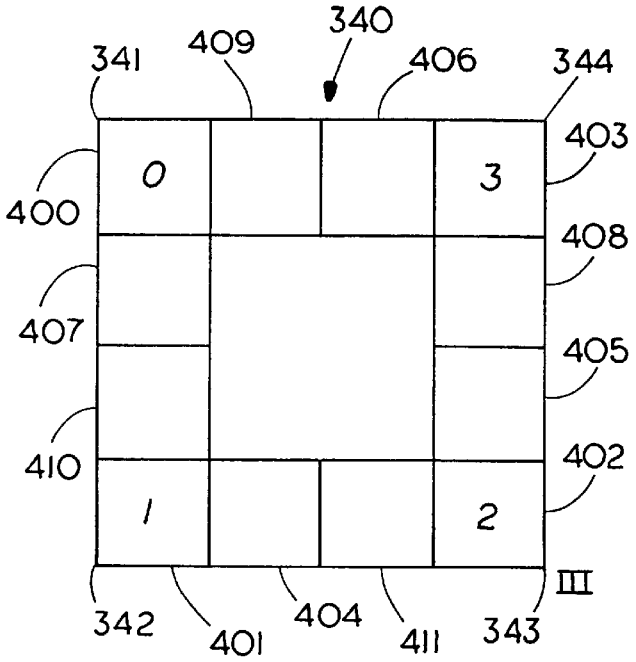
FIGS. 6A–6C show a plan view of the template of FIG. 5 indicating the process for numbering the template positions.
Figure 6B:
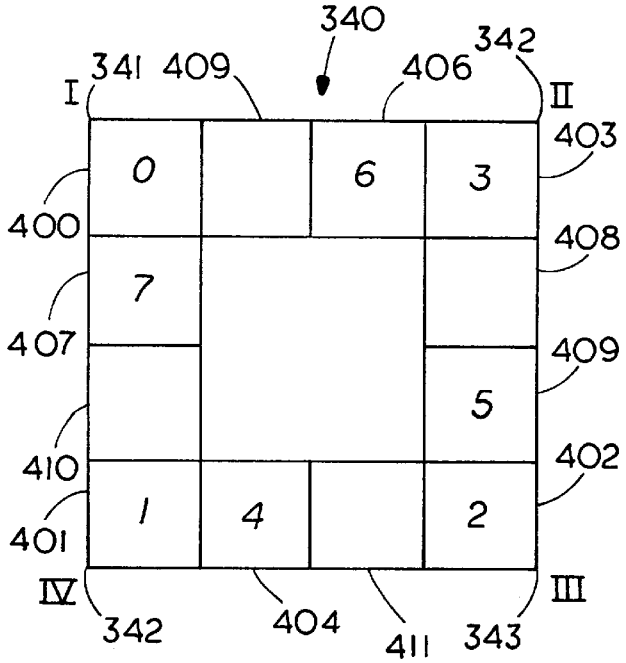
Figure 6C:
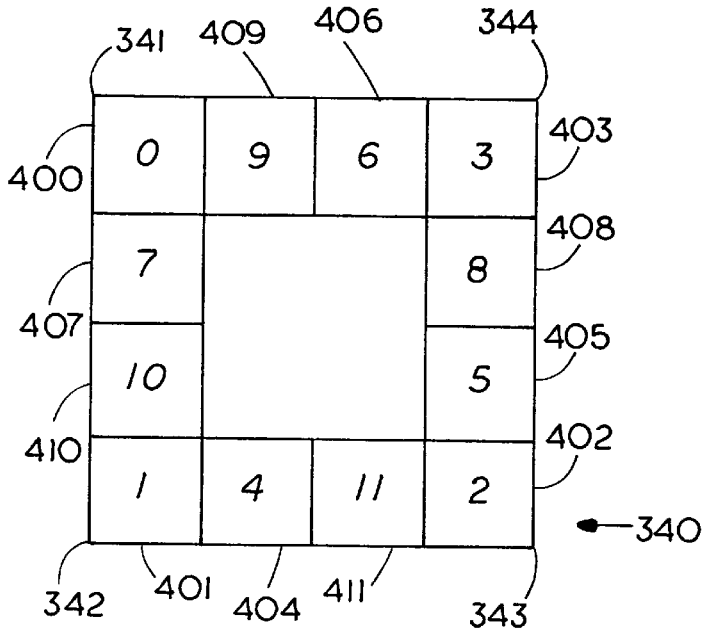

The method for obtaining the particular sequence of template numbers shown in FIG. 5 is described with reference to FIGS. 6A through 6C which shows a plan view of the template 340 and illustrates the process of numbering the twelve positions. Beginning at corner 341, and working counter clockwise as shown, the template corners 341, 342, 343, 344 are numbered 0, 1, 2, 3, as shown in FIG. 6A. Now, as shown in FIG. 6B, beginning at side two/position two and working counter clockwise, all position two's on the template 340 are numbered 4, 5, 6, 7, respectively. Finally, as shown in FIG. 6C, starting with side three/position three and working counter clockwise again all position three's on the template are assigned template numbers 8, 9, 10, and 11, respectively. For embodiments having more than four sides, the numbering continues with side four/position four to number the position fours, and then side five/position five to number all of the position fives, etc.

Figure 7B:
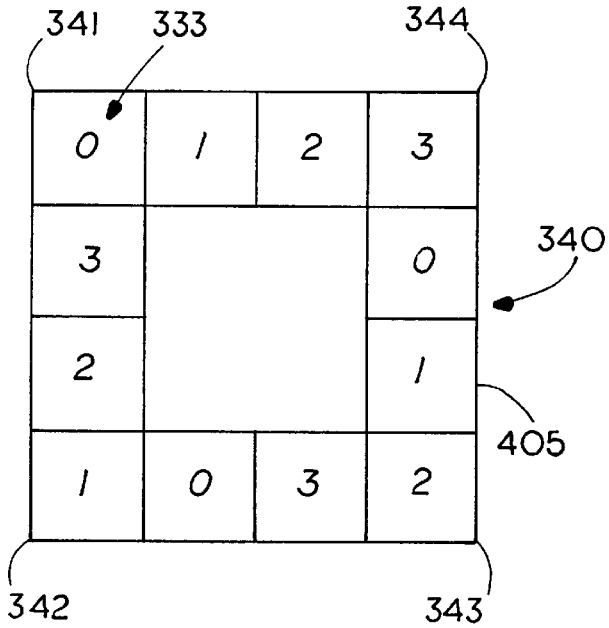
FIG. 7B shows a plan view of the template of FIG. 5 wherein the template numbers shown in FIGS. 6A–6C are replaced with corresponding valves obtained from an operation performed on the template numbers.
Figure 7A:
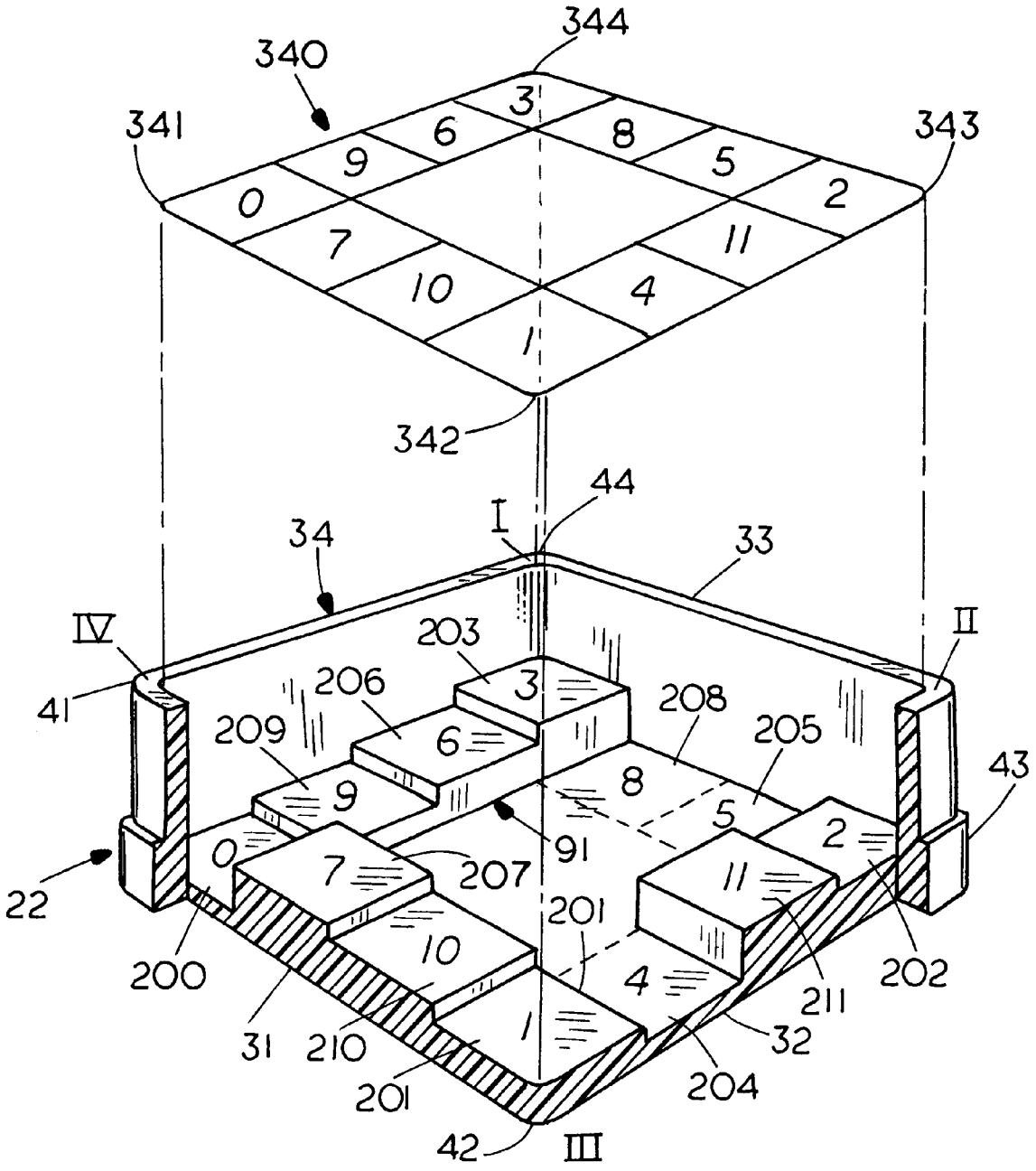
FIG. 7A shows a perspective view of the template of FIG. 5 superimposed on the base of the slicer guide of FIG. 1.

FIG. 7A shows the template 340 and base 22 as configured in FIG. 5, but with the cutting board removed and the guidewall 26 at sides 31 and 32 cut away for clarity. FIG. 7A is used to explain the application of the template numbers to the determination of the relative heights of the shims 91. The relative heights of the shims are determined by the equation:

$$P \bmod S = H$$

wherein P is the template number as superimposed on the base as shown in FIG. 7A, S is the number of sides (in the preferred embodiment S=4), and H is the relative height of the corresponding shim. Mod is a mathematical function performed upon two whole numbers where the result is the remainder after dividing the first number by the second number. Accordingly, where H=3, such as when P is 3, 7, 11, at the third, seventh and eleventh shims 203, 207, 211, respectively, these shims are tallest and are considered a shim set. The next tallest shims are where H=2, such as when P is 2, 6 and 10, at the second, sixth and tenth shims 202, 206, 210, respectively, and are also a shim set. The smallest shims are where H=1, such as when P is 1 and 9, at the first and ninth shims 201 and 209, respectively, and make-up another shim set. There are no shims (i.e., only baseplate 25) where H=0 such as when P is 0, 4 and 8, at positions corresponding with shims 200, 204 and 208 (shown in phantom). Note in the preferred embodiment, there is no shim, only baseplate 25, corresponding where P=5 (indicated in phantom at 205).

FIG. 7B shows the template 340 wherein the template numbers are replaced with their corresponding values of H 333 obtained from P mod S=H for the template numbers shown in FIG. 6C and wherein S=4, as described herein. As indicated in the figure, the numbering of the positions on template 340 according to the value of H is a series of consecutive repeating sequences of 0 to (S−1). In FIG. 7B, the sequence if 0, 1, 2, 3, and is repeated three times around the template 340. In general, the number of times a sequence is to be repeated is (S−1). In general, the number of shim. sets is equal to the number of sides S, wherein the shim set for H=0 can be no shim (i.e., only baseplate 25). The preferred embodiment, as shown for example in FIG. 7A, includes a series of repeating sequences of shims of various heights, however, this series is not consecutive because there is no shim, only baseplate where the template number is 5, indicated on FIG. 7B as 405.

Figure 8:
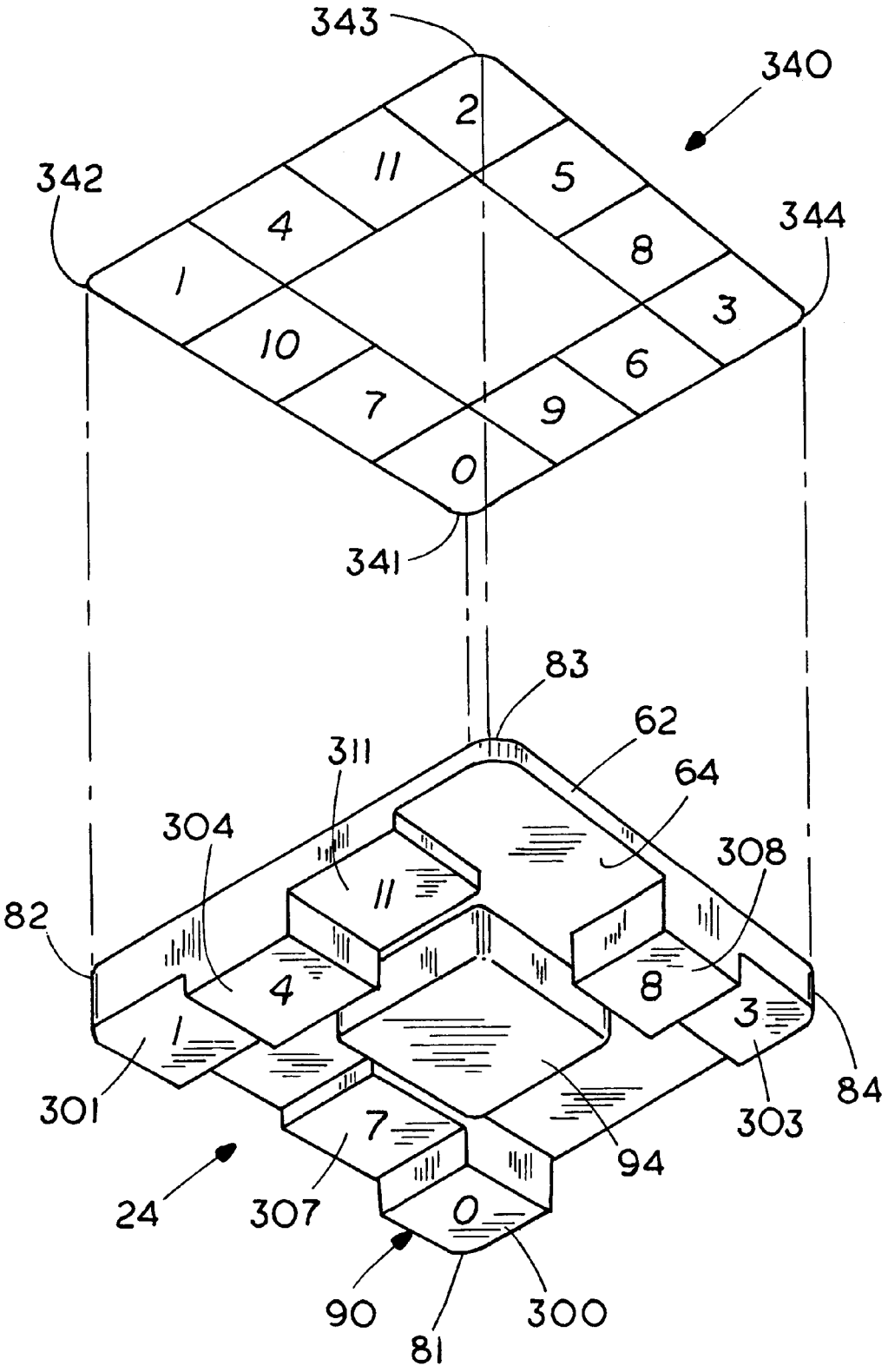
FIG. 8 shows a perspective view of the template superimposed on the cutting board of the slicer guide of FIG. 1.

FIG. 8 shows the template 340 and cutting board 24 as configured in FIG. 5, but as a view from underneath the cutting board 22 to show pads 90. The template numbers are superimposed on the pads for clarity. In this configuration, a primary pad is positioned wherever P mod S=0, such as at pads 300, 304 and 308. A minor pad is positioned at P mod S=3, such as pads 303, 307 and 311. In the preferred embodiment, an intermediate pad 301 is placed at the location corresponding to template number 1.

In the preferred embodiment, the tallest shim set, i.e, shims 203, 207, 211, has a height of 0.625 inches. The next tallest shim set, i.e., shims 202, 206, 210, has a height of 0.5 inches. The shortest shim set, i.e., shims 201 and 209, has a height of 0.125 inches. In the preferred embodiment, the primary pads, i.e., pads 300, 304 and 308, have a height of 0.75 inches. The minor pads, i.e., pads 303, 307 and 301 have a height of 0.125 inches. The intermediate pad, i.e., pad 301 has a height of 0.5 inches.

FIG. 2 shows how the pads 90 mate with the shims 91 in the preferred embodiment to provide the configuration shown in FIG. 4D. The primary pads 300, 304, 308, lay on the baseplate 25. The minor pads 303, 307 and 311 mate with shims 203, 207 and 211, respectively. The intermediate pad 301 mates with shim 201. The height of the guidewall and thickness of the cutting surface are set in a known manner to provide a spacing of about 0.75 inches between the cutting surface 60 and the cutting guide surface 50. In the present embodiment the distance between the baseplate 25 and the cutting guide surface 50 as measured along the guidewall inner surface 27 is approximately 1.625 inches. Also, the distance between the cutting surface 60 and the underside surface 64 is measured along the edge 62 is approximately 0.125 inches.

Figure 9:
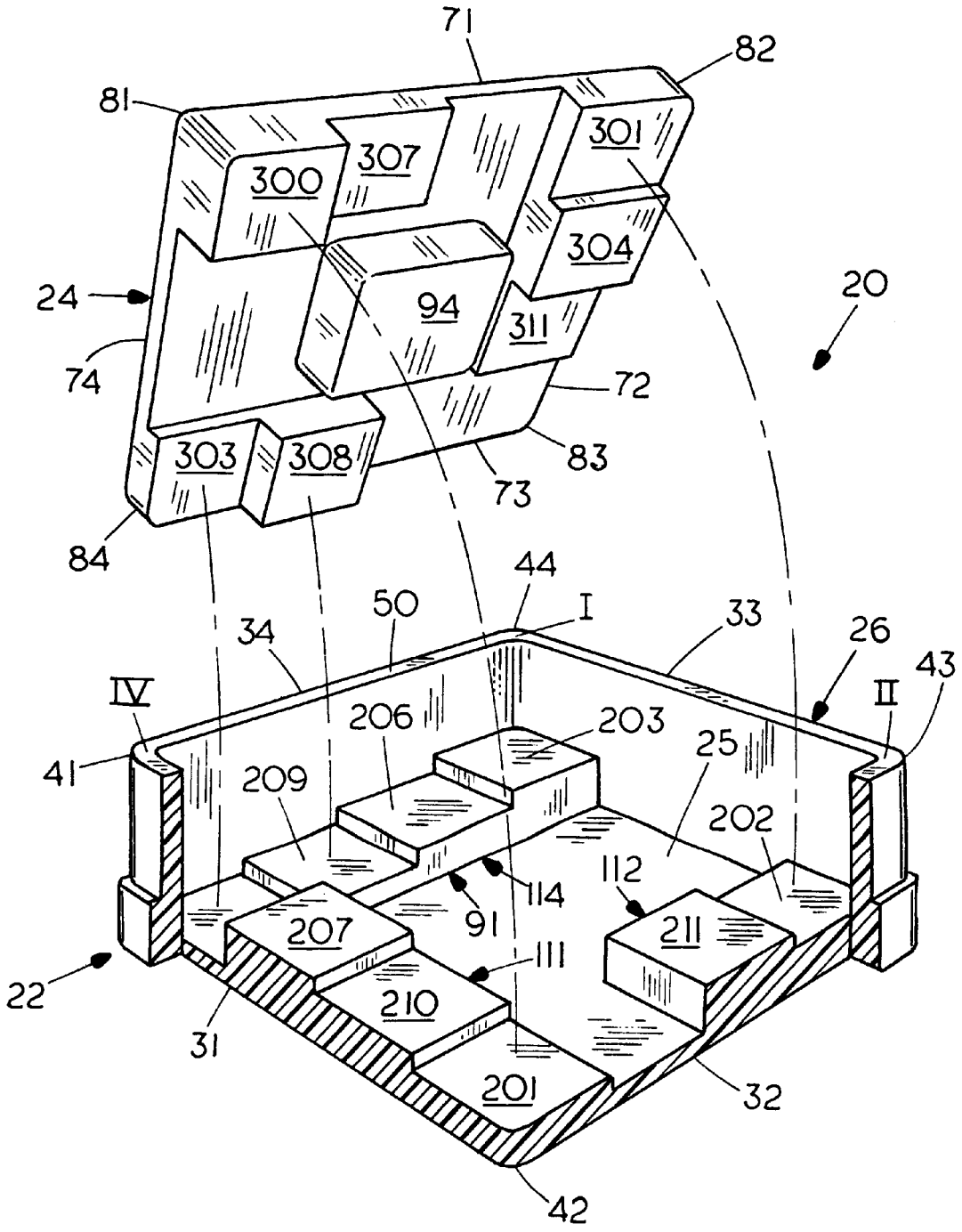
FIG. 9 shows a perspective view of the slicer guide of FIG. 1 and indicating a second configuration.

FIG. 9 shows how the pads 90 mate with the shims 91 in the preferred embodiment to provide the configuration shown in FIG. 4C. Primary pads 300 and 308 mate with the smallest shims, i.e., shims 201 and 209, respectively. The intermediate pad 301 mates with shim 202. This provides spacing of about 0.5 inches between the cutting surface 60 and the cutting guide surface 50. Primary pad 304 does not mate with a shim 91 or lay on the baseplate 25. The third point in the three point support of the cutting board 24 is the intermediate pad 301 mating with shim 202.

Figure 10:
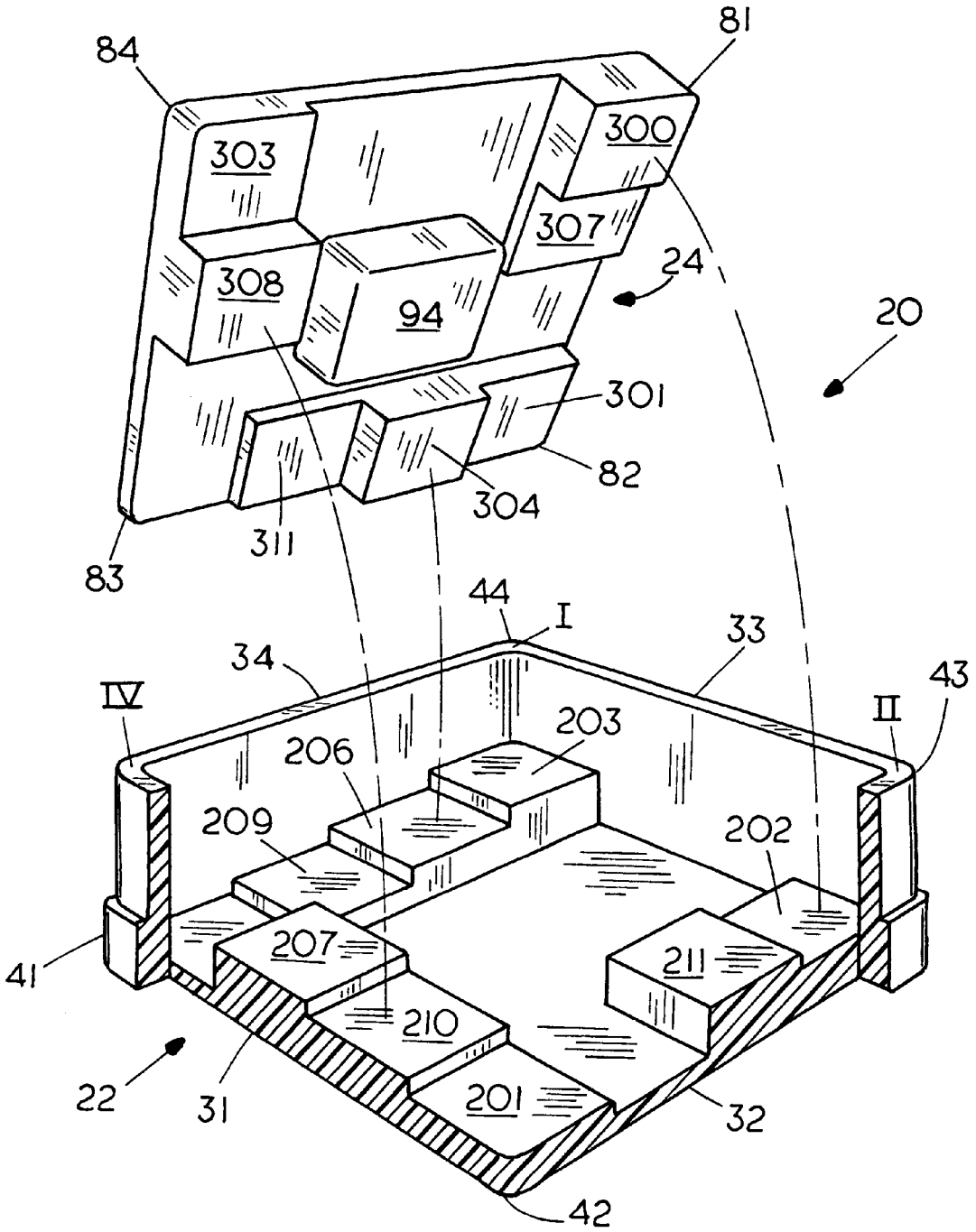
FIG. 10 shows a perspective view of the slicer guide of FIG. 1 and indicating a third configuration.

FIG. 10 shows how the pads 90 mate with the shims 91 in the preferred embodiment to provide the configuration shown in FIG. 4B. The primary pads 300, 304, 308 mate with shims 202, 206, and 210, respectively. This provides a spacing of about 0.25 inches between cutting surface 60 and cutting guide surface 50.

Figure 11:
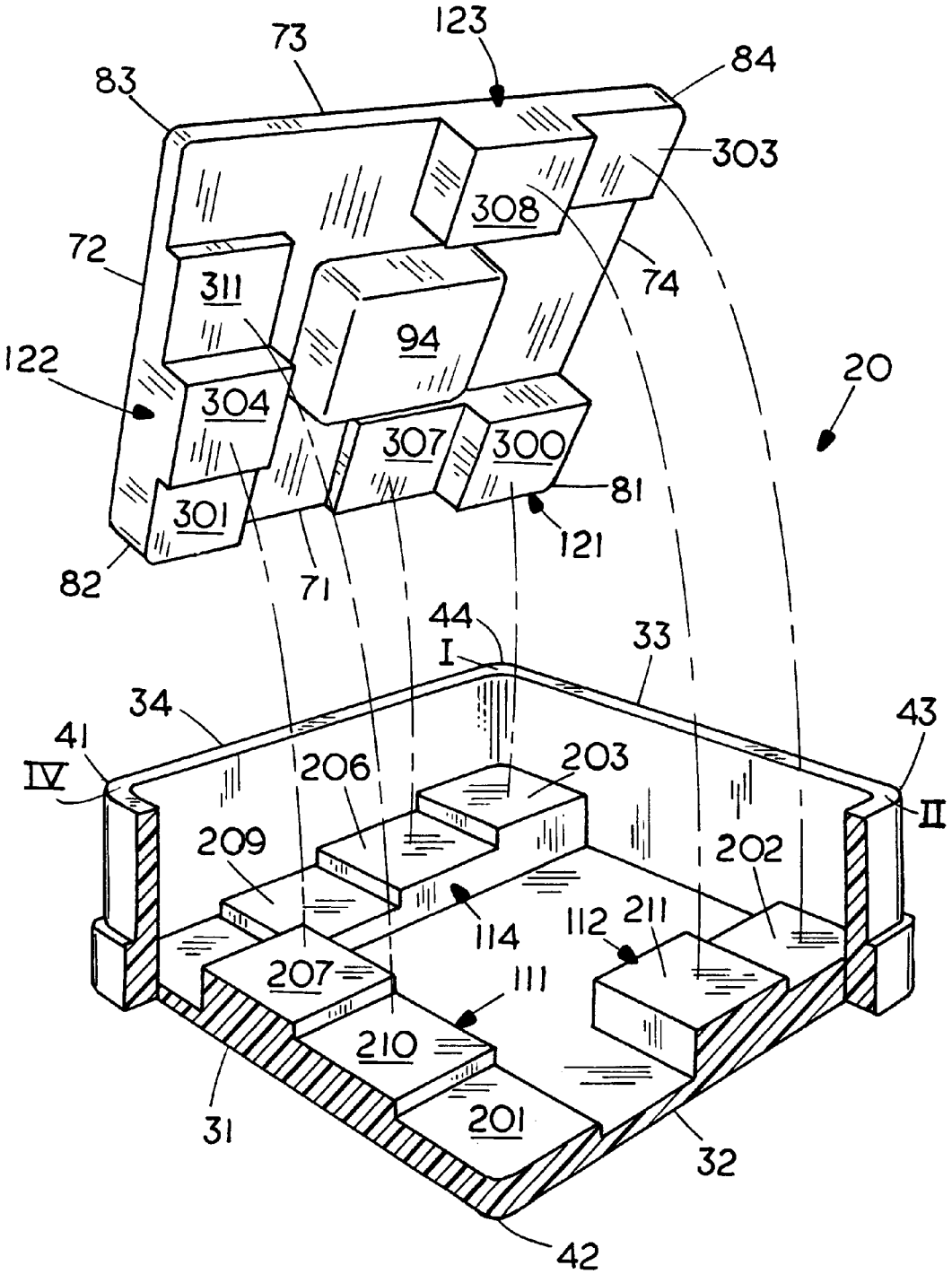
FIG. 11 shows a perspective view of the slicer guide of FIG. 1 and indicating a fourth configuration.

FIG. 11 shows show the pads mate with shims in the preferred embodiment to provide the configuration shown in FIG. 4A. The primary pads 300, 304, 308 mate with the tallest shims, i.e., shims 303, 307 and 311, respectively. This provides a spacing of about 0.125 inches between the cutting surface 60 and cutting guide surface 50.

Although the present invention has been described with reference to preferred embodiments, workers skilled in the art will recognize that changes may be made in form and detail without departing from the spirit and scope of the invention.

What is claimed is:

1. A slicer guide, comprising:

a square base having four base sides and four base corners and including:

a generally upstanding guidewall formed to enclose a square, having a cutting guide surface at one end and an inner surface, and a plurality of shim sets each having a unique height, wherein each shim set includes a plurality of shims having generally equal height, the shim sets positioned proximate to the inner surface of the guidewall and arranged such that the shims of each shim set are spaced apart from each other, the shims being arranged in a plurality of shim steps such that each step includes one of said shims from said plurality of shim sets, wherein the plurality of shim steps includes first shim steps being arranged proximate a first base side and spaced apart from a first base corner, the first shim steps including a shim from each of the shim sets arranged in ascending height in a direction along the first base side away from the first base corner, second shim steps being arranged proximate a second base side, adjacent the first base side, and spaced apart from the first base corner, the second shim steps including a shim from each of the shim sets arranged in descending height in a direction along the second base side away from the first base corner, and third shim steps being proximate a second base corner opposite the first base corner and including shims from two shim sets arranged in ascending height in a direction along a third base side toward the second base side; and generally square cutting board having four sides and four corners removably positioned within the guidewall of the base in a plurality of selectable positions, the cutting board fitting within the guidewall of the base in each of the selectable positions, the cutting board including:

a cutting surface, and an underside surface generally opposite the cutting surface, the underside surface including a plurality of primary pads having a generally equal heights a first of the plurality of primary pads being proximate a first corner of the cutting boards, a second of the primary pads being proximate a first side of the cutter board and spaced apart by a distance from a second corner of the cutting board that is opposite the first corner thereof, and a third of the primary pads being proximate a second side of the cutting board adjacent the first side thereof, and spaced apart by the distance from the second corner thereof, and the cutting board further including an intermediate pad disposed on the cutting board underside surface proximate a third corner of the cutting board and the second primary pad;

a first minor pad disposed on the cutting board underside surface proximate the second primary pad and spaced from a second minor pad disposed on the cutting board underside surface proximate a fourth corner of the cutting board and the third primary pad; and wherein for each of the selectable positions at least some of the primary pads mate with one of the shim sets to provide a selected spacing between the cutting guide surface and the cutting surface.

* * * * *

UNITED STATES PATENT AND TRADEMARK OFFICE

CERTIFICATE OF CORRECTION

PATENT NO. : 5,924,352
DATED : July 20, 1999
INVENTOR(S) : Arlan D. Lothe

It is certified that error appears in the above-identified patent and that said Letters Patent is hereby corrected as shown below:

Column 7, line 18, insert --a-- at the start of the line.

Column 7, line 27, cancel "heights" and insert --height--.

Column 8, line 2, cancel "boards" and insert --board--.

Column 8, line 18, after "from" insert --the second corner of the cutting board, and--.

Column 8, line 21, after ";" delete second occurence of "and".

Signed and Sealed this

Seventeenth Day of October, 2000

*Attest:*

Q. TODD DICKINSON

*Attesting Officer*

*Director of Patents and Trademarks*